US008402983B2

(12) United States Patent
Harland et al.

(10) Patent No.: US 8,402,983 B2
(45) Date of Patent: Mar. 26, 2013

(54) GAS DISTRIBUTION SYSTEM

(75) Inventors: Leon Andre Harland, La Colle sur Loup (FR); Mohsin Siddiqui, Houston, TX (US); Willem Cornelis Van Wijngaarden, Gorinchem (NL)

(73) Assignee: Single Bouy Moorings, Inc., Marly (CH)

( * ) Notice: Subject to any disclaimer, the term of this patent is extended or adjusted under 35 U.S.C. 154(b) by 1699 days.

(21) Appl. No.: 11/343,674

(22) Filed: Jan. 31, 2006

(65) Prior Publication Data

US 2006/0180231 A1 Aug. 17, 2006

Related U.S. Application Data

(60) Provisional application No. 60/653,734, filed on Feb. 17, 2005.

(51) Int. Cl.
*F17D 3/01* (2006.01)

(52) U.S. Cl. ..... 137/1; 137/236.1; 441/4

(58) Field of Classification Search ..... 441/4, 5; 137/236.1, 1

See application file for complete search history.

(56) References Cited

U.S. PATENT DOCUMENTS 3,898,846 A * 8/1975 McCabe ..... 405/210
4,302,130 A * 11/1981 Mo ..... 405/210
4,924,911 A * 5/1990 Schmalenbach et al. .. 137/625.5
5,713,426 A * 2/1998 Okamura ..... 180/65.3
6,298,671 B1 * 10/2001 Kennelley et al. ..... 62/50.2
6,329,725 B1 * 12/2001 Woodall et al. ..... 307/19
6,390,733 B1 * 5/2002 Burbage et al. ..... 405/203
6,745,801 B1 * 6/2004 Cohen et al. ..... 141/231
7,322,387 B2 * 1/2008 Landry et al. ..... 141/382
2002/0073619 A1 6/2002 Perkins et al.
2004/0187385 A1 9/2004 Perkins et al.
2006/0010910 A1 * 1/2006 Hubbard ..... 62/611

* cited by examiner

*Primary Examiner* — William McCalister
(74) *Attorney, Agent, or Firm* — Leon D. Rosen

(57) ABSTRACT

An economical system provides gaseous hydrocarbon to numerous locations (16, 18) that are each in the vicinity of an ocean coast, such as islands in a developing country, so the coastal inhabitants have access to low cost, easily supplied by pipeline and clean-burning natural gas. The system includes a local supply station (24), or hub, that stores natural gas, as by receiving LNG (liquefied natural gas) that has been liquefied by cooling it to −160° C., from a large tanker (20) having a storage capacity of over 50 million standard cubic feet of natural gas. Shuttle boats (40) that each has a much smaller LNG storage capacity than the tanker, load LNG from the local supply station, carry it to one of a plurality of local coastal stations (12, 14), heat the LNG to produce gaseous hydrocarbons, and transfer the gaseous hydrocarbons to an offshore receiving facility of the local coastal station. The gaseous hydrocarbons are then used by the local coastal station as to distribute gaseous hydrocarbons to residents of the island or to fuel an electricity generating plant.

3 Claims, 4 Drawing Sheets

160
162
164
170
190
182
192
176
172
174

164
182
176
180
184
185
186
188

GAS DISTRIBUTION SYSTEM

CROSS-REFERENCE

Applicant claims priority from U.S. Provisional application Ser. No. 60/653,734 filed Feb. 17, 2005.

BACKGROUND OF THE INVENTION

Natural gas is the most common type of hydrocarbon that is in a gaseous state at common environmental temperatures (e.g. 8° C.). Natural gas is well recognized as a low cost, easily-handled and clean burning fuel, as it is often priced below liquid oil, it can be distributed to households and businesses by pipeline, and it creates little emissions other than carbon dioxide. Natural gas is produced at many locations in much larger quantities than can be used locally, and it is transported to faraway customers by cooling it as to −160° C. to produce LNG (liquefied natural gas). The LNG is transported in tankers that each has a capacity of more than 50 million standard (atmospheric pressure and environmental temperature) cubic feet of natural gas, to far away receiving locations. The receiving locations are usually large facilities in developed countries where the large amounts of natural gas can be sold at market prices. The owners of the large LNG receiving facilities spend large amounts to provide extensive distribution pipelines for the gas, and the owners enter into long term (20 plus years) contracts with the suppliers of LNG.

There is a demand for natural gas in isolated communities of developing countries, with many of such communities being located near ocean coasts. Some examples are the islands of Indonesia and the Philippines. Although gas could be supplied by LNG tankers to such isolated communities, the demand at each community is too small to justify the cost of a facility that can offload and regas (heat) the large amount of LNG carried by each tanker, and LNG suppliers generally are not interested in providing additional small tankers. A system that enabled natural gas to be provided to isolated coastal communities, would be of value.

SUMMARY OF THE INVENTION

In accordance with one embodiment of the invention, an economical system is provided for distributing natural gas to each of a plurality of local coastal stations positioned in the vicinity of coastal communities. The system includes a local supply station that supplies the natural gas to shuttle boats, or barges that each has a limited storage capacity. Each barge sails or is towed to one or more local coastal stations where the natural gas is unloaded to a receiving facility on a local coastal station. The local coastal station distributes the natural gas to customers lying in the vicinity of the local coastal station. Where the natural gas has been delivered as LNG (liquefied natural gas) by a tanker (storage capacity of at least 50 million standard cubic feet of natural gas) to the local supply station, with the gas having been cooled to about −160° C. to constitute LNG, the supply station merely stores the LNG and offloads LNG to the barges. The barges are designed to carry LNG, and the barges or coastal stations have regas equipment for heating the LNG to gasify it and to heat it, preferably to at least −1° C., so the gaseous warmed natural gas can be delivered though pipelines to customers in the vicinity of the local coastal station. Where the natural gas has been produced from an underground reservoir at the supply station, the gaseous natural gas is delivered to barges that are constructed to carry CNG (compressed natural gas) to the local coastal stations.

The novel features of the invention are set forth with particularity in the appended claims. The invention will be best understood from the following description when read in conjunction with the accompanying drawings.

DESCRIPTION OF THE PREFERRED EMBODIMENTS

Figure 1:
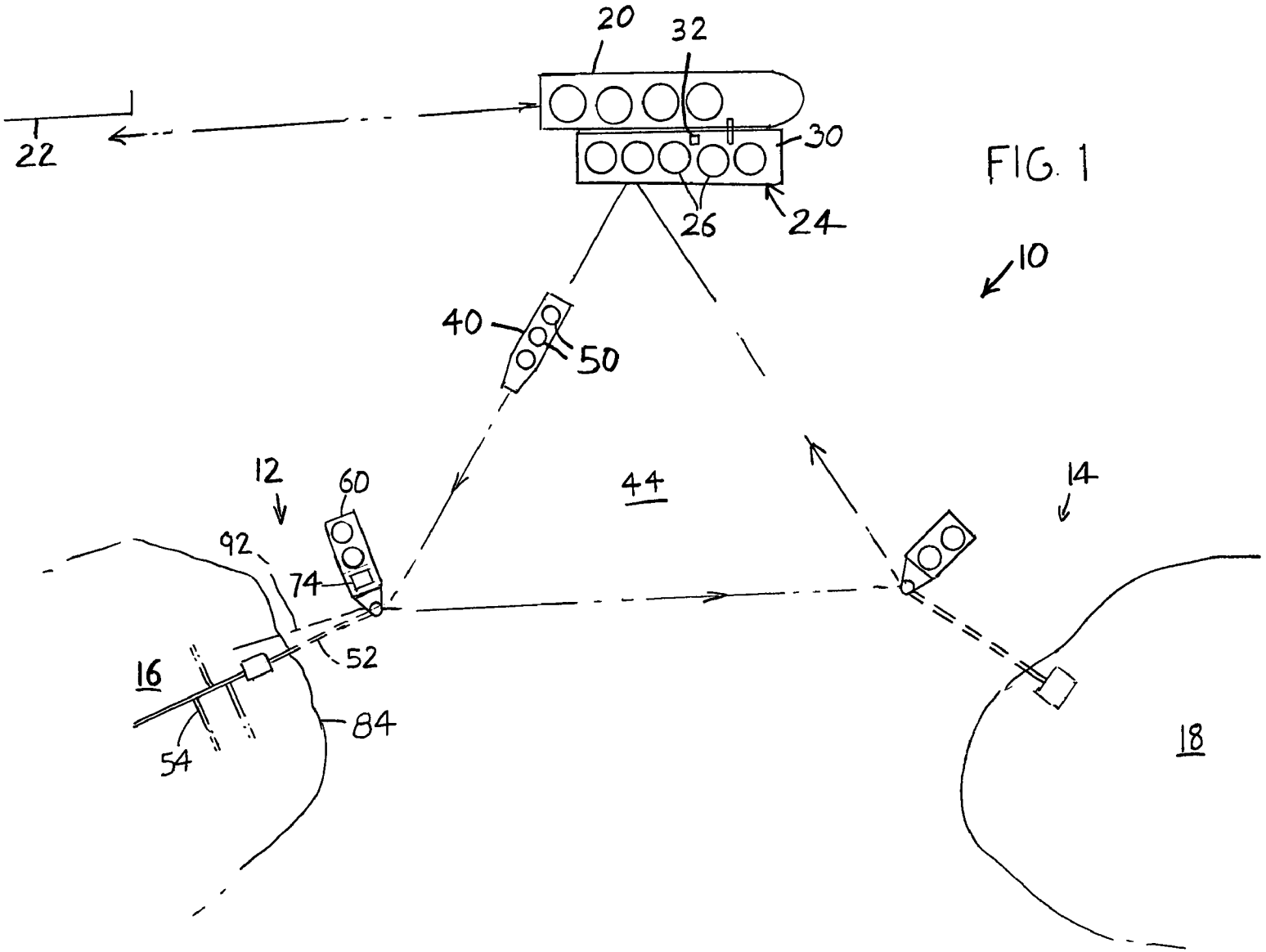
FIG. 1 is a plan view of a gas distribution system for economically providing natural gas to numerous isolated coastal communities.

FIG. 1 shows a distribution system 10 for distributing natural gas (hydrocarbons that are gaseous at environmental temperatures such as 8° C. and atmospheric pressure) to each of a plurality of local coastal stations 12, 14 that lie in the vicinity of small coastal communities 16, 18 that are usually separated from each other by a plurality of kilometers. Each community generally includes less than one million people within 20 kilometers of the coastal station. The natural gas has been produced from underground (under the land and/or the sea) reservoirs that contain significant quantities of natural gas. Such reservoirs usually contain significant amounts of liquid oil (hydrocarbons that are liquid at 8° C. and atmospheric pressure) that is more easily transported to far-away customers and that is therefore more valuable to the hydrocarbon producer. Until the last few years, such produced natural gas which could not be delivered by short pipelines to local communities was often flared (burned just to get rid of it). More recently, the price of natural gas has risen so it is economical to transport natural gas to far away customers.

Currently, natural gas has been transported by cooling the natural gas to below the temperature at which it is liquid at atmospheric pressure, such as −160° C. (−256° F.) to create LNG (liquefied natural gas), and loading it into special insulated tanks on an LNG tanker. Large tankers that can store at least 50 million cubic feet of standard gas (gas at an environmental temperature such as 8° C. and atmospheric pressure) have been used. The receiving station was provided with facilities for unloading all of the LNG from the tanker in a short time such as a few days, because the rental rate for such tankers is about $100,000 per day. The receiving station also had facilities for storing the LNG and regasing it (heating the LNG to gasify it) quickly and for distributing all of the natural gas to customers. The owners of the receiving station typically entered into contracts requiring them to purchase large quantities of natural gas for long periods such as over 20 years, and the producer would enter into such contracts before building or acquiring the gas liquefying facility and tanker(s). The receiving stations were usually located in developed countries at locations with access to large cities.

There is a great demand for natural gas in smaller isolated communities. Natural gas can cost less than liquid oil, it is easily distributed limited distances by pipeline, and it has limited emissions (substantially only carbon dioxide). Producers who fill tankers with LNG have previously ignored such isolated communities, largely because of the limited demand for natural gas in each isolated community. In accordance with the present invention, applicant provides gas distribution systems that allow natural gas to be economically distributed to such isolated communities, at least when such communities lie in the vicinities of ocean coasts.

The gas distribution system 10 shown in FIG. 1 includes an LNG tanker 20 that carries large amounts (at least 50 million standard cubic feet) of LNG (liquefied natural gas) from a distant LNG source 22 to a local supply station 24. At the local supply station 24, a mass of LNG is offloaded from the tanker to a storage facility 30 of the station, which includes insulated tanks 26 where the very cold LNG is stored. It may take a few days to unload the LNG from the tanker. The offloaded LNG is not heated to turn it into gas, as has been previously done at LNG tanker receiving stations, but it is kept cold and liquid as by the use of refrigeration equipment 32 and highly insulated tanks. The local supply station may be located on land or in the sea, so it is not necessarily on or close to a coast.

The gas distribution system also includes LNG barges, or shuttle boats such as 40 that carries LNG from the local supply station 24 to at least one of the local coastal station 12, 14 that lies at the coast or shore 84 of a sea 44, and in the vicinity of a community 16, 18 that consumes natural gas (either directly or by consuming electricity produced using natural gas as fuel). The shuttle boat 40 has an LNG-holding capacity less than 50% and usually less than 25% of the capacity of the tanker.

Figure 2:
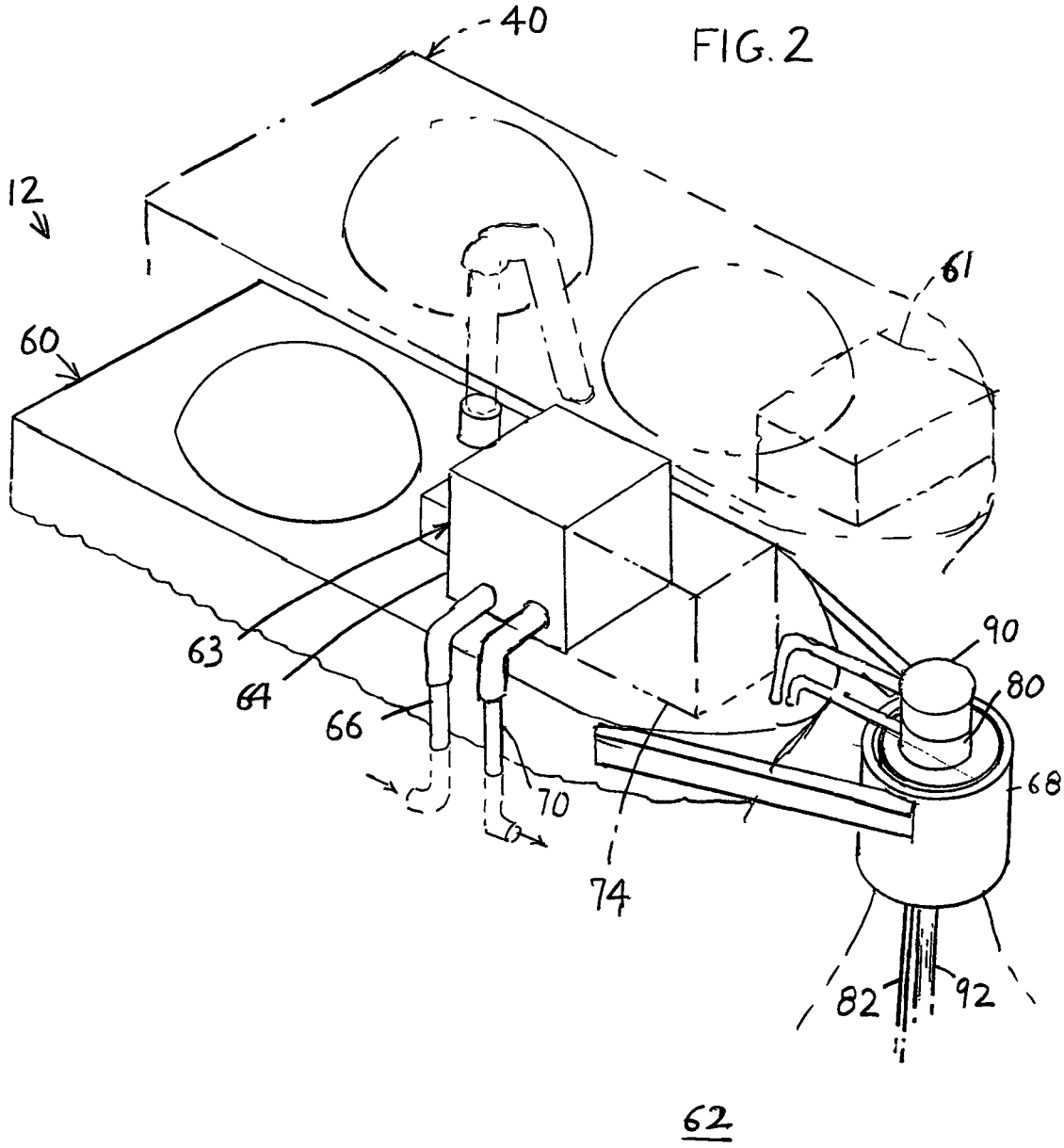
FIG. 2 is an isometric view of a local coastal station, and showing in phantom lines a shuttle in the process of offloading LNG from the shuttle into the local coastal station.

At intervals, the shuttle boat 40 sails to the local supply station 24, where insulated tanks 50 on the shuttle boat receive LNG that has been stored at the local supply station. The shuttle boat then sails away to one of the local coastal stations such as 12. At the local coastal station, the LNG is heated to regas it and the gaseous hydrocarbons are transferred through an underwater conduit 52 to a gas storage facility of the coastal station (which may comprise a network of pipelines 54). In FIG. 2, the local coastal station includes a floating structure 60 that is moored to the sea floor 62 as by a turret 64 moored by catenary lines, to allow the structure to weathervane, or the structure is spread moored. FIG. 2 shows a shuttle boat 40 that does not carry LNG heating equipment (although it could) at 61, but the floating structure 60 of the coastal station does carry such equipment 63. Such heating equipment for regasing includes a heat transfer system 68 that has a hose or pipe 66 that takes in sea water and another hose or pipe 70 that releases cold water to the sea, or that uses ambient air to heat the LNG. Heat transferred away from the water is used to heat the LNG so it becomes a gas, and to further heat the very cold gas to a temperature, preferably of at least −10° C. and preferably warmer, so large amounts of ice do not form on pipes that carry the gas.

In FIG. 2 the floating structure carries a power plant 74 that generates electricity, using hydrocarbon gas as fuel. The electricity is passed though a swivel 80 on the turret 64 and through an underwater cable 82 to shore 84 (FIG. 1) where the electricity is distributed to customers. In addition, gaseous hydrocarbon is passed though a swivel 90 (FIG. 2) on the turret and through an underwater pipeline 92 to the shore where it is distributed to customers. If the shuttle boat capacity is much greater than the demand for natural gas from the local coastal station 12, then the shuttle may sail away to a next local coastal station 14 (FIG. 1) to unload LNG at the second station. Each shuttle boat may be self propelled, or may be pulled by a tugboat. However, it is desirable that all shuttle boats be of the same design to minimize costs. A shuttle boat can be used to store additional LNG at the local supply station.

Figure 3:
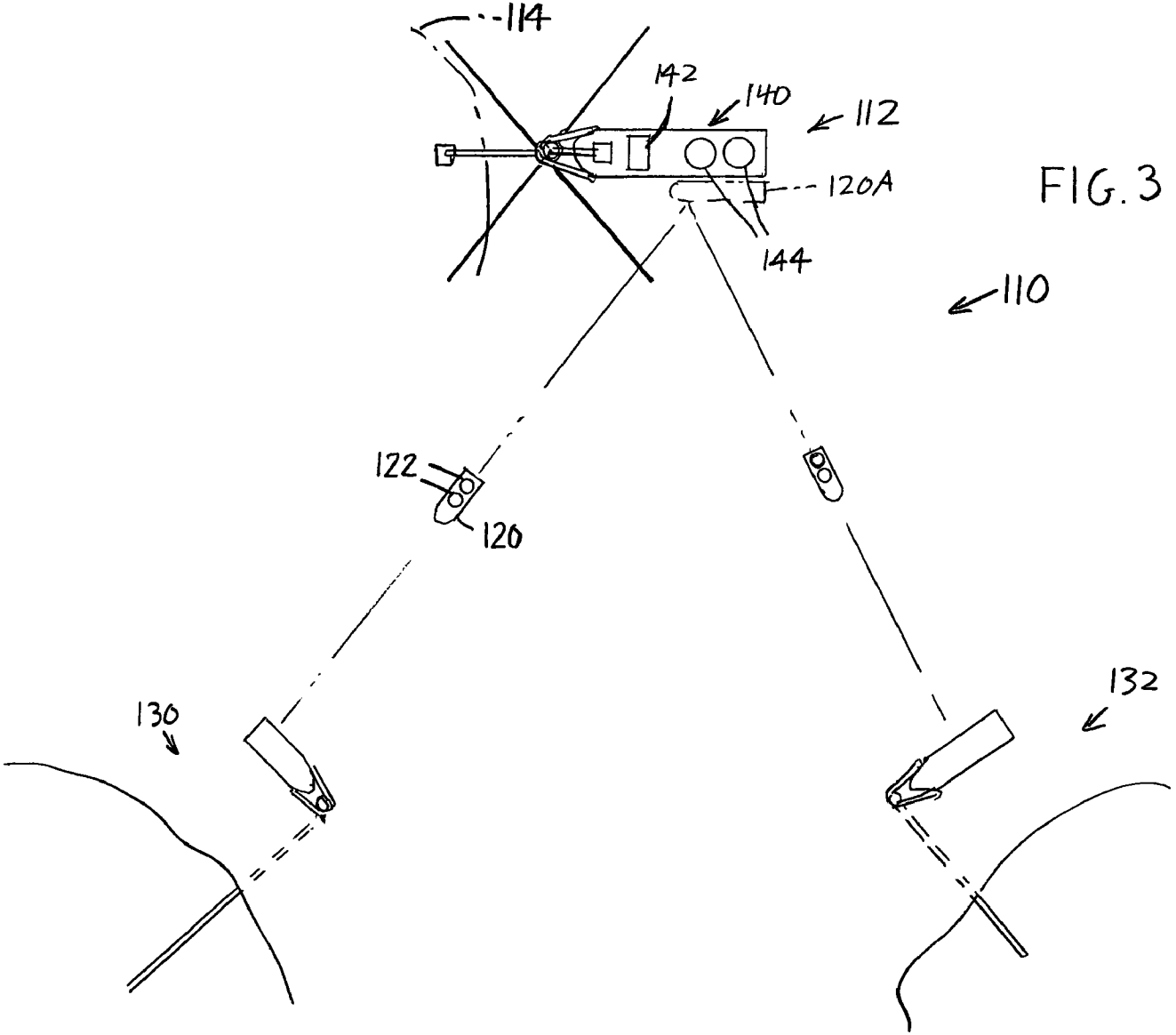
FIG. 3 is a plan view of a gas distribution system of another embodiment of the invention.

FIG. 3 shows a system 110 in which a local supply station 112 produces natural gas from an underground (under the land or the sea) hydrocarbon reservoir 114 that contains natural gas. Although it would be possible to refrigerate the natural gas to turn it into LNG (liquefied natural gas) so large quantities could be carried in a shuttle, applicant prefers to not refrigerate the gas, but to use shuttles 120 that have pressure tanks 122 that carry highly pressurized natural gas in a gaseous state (e.g. at 3000 psi). For a given size shuttle, the mass of natural gas that can be carried by a shuttle boat is less for a shuttle that carries CNG (compressed natural gas) than for a shuttle that carries LNG (liquefied natural gas). However, the fact that the natural gas does not have to liquefied and later regassed, usually makes it more economical to transport CNG in the shuttle boat for short distances. Where the local coastal stations 130, 132 are close to the local supply station 112, such as no more than 400 kilometers away, so a shuttle boat one-way trip can be accomplished in one day, the limited storage capacity of the CNG shuttle is largely compensated for by the faster loading and unloading of the shuttle boat and by more trips of the shuttle boat between the supply station 112 and a local coastal station 130 and/or 132, and possibly by using more but cheaper shuttle boats for a given gas distribution system.

The local supply station 112 is shown as including a floating production unit 140 that carries equipment 142 for processing produced hydrocarbons. Natural gas is stored under pressure in tanks 144, and is offloaded to a shuttle boat at 120 A when the shuttle boat returns. The storage capacity in tanks 144 is preferably at least 5 million standard cubic feet of natural gas, and the storage capacity is preferably greater than the storage capacity in a single shuttle boat.

A natural gas distributing system can be set up at minimal cost by establishing a local supply station and a limited number of coastal stations such as one of them. Where the local supply station obtains natural gas by producing it from a local hydrocarbon reservoir, the cost for the local supply station can be minimal because limited storage capacity is required and no refrigeration system is required. In that case, the local supply station will be set up in the vicinity of a hydrocarbon reservoir that produces large amounts of gaseous hydrocarbons. The local supply may be located offshore or onshore, and may be connected by a pipeline to a production facility lying over a reservoir. Where the local supply station receives LNG from a distant source, the initial cost for the local supply station is greater because it usually must have sufficient LNG storage capacity to store all of the LNG offloaded from a large tanker (minus the amount of LNG that is regassed while the tanker is offloaded). It is possible to make arrangements with an LNG supplier so a tanker arrives with a new shipment of LNG only when needed (which will be more frequent when the system expands). The initial cost for an LNG local distribution system is greater because the shuttle boat(s) or local station(s) must have heating, or regas, facilities. However, once other local communities see that natural gas is available locally, they are more likely to advance funds to build additional coastal station to receive LNG or CNG.

Figures 4, 5:
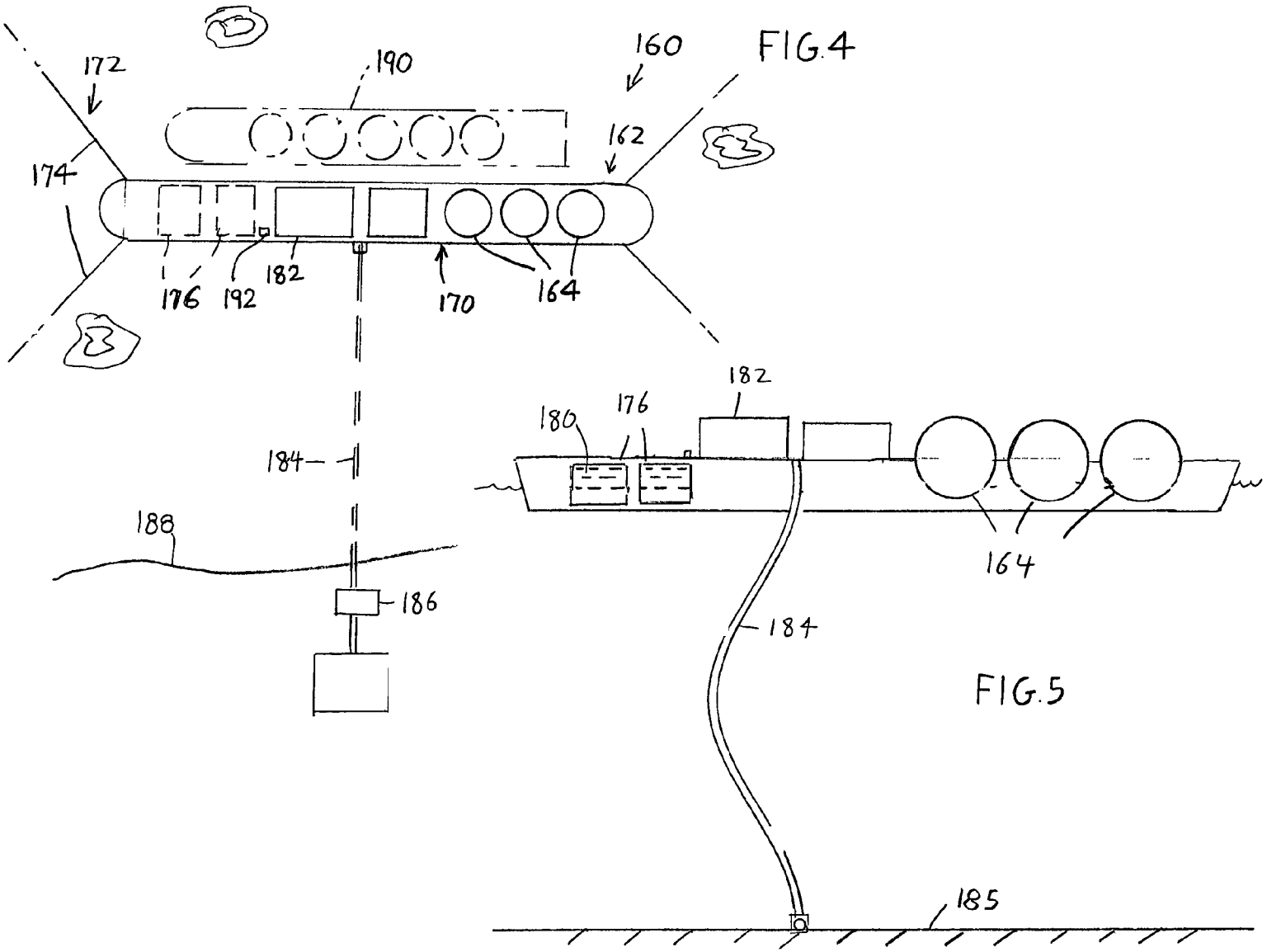
FIG. 4 is a plan view of a system having a power plant to produce electricity for distribution to consumers.
FIG. 5 is a side view of the system of FIG. 4.

FIGS. 4 and 5 show a system 160 which includes a local supply station 162 that has insulated tanks 164 that store LNG. The local supply station 162 is shown as including a floating structure 170 and a spread mooring facility 172 that includes lines 174 that extend to the sea floor. The floating structure has tanks 176 that are not insulated and that store liquid hydrocarbons (hydrocarbons that are liquid at ambient temperatures). The floating structure also has a power plant 182 that can use gaseous or liquid hydrocarbons as fuel to produce electricity. The electricity is delivered along an in-sea power cable 184 having a portion on the sea floor 185, to a shore-based distribution facility 186 that lies near a coast 188 and that distributes electricity to consumers.

The reason for storing a considerable amount of liquid fuel (e.g. 1 week of diesel fuel for the power plant) is to provide a reserve to energize the power plant 182 in the event that gaseous hydrocarbons are not avoidable. It is much less expensive to provide uninsulated tanks 176 to store LNG, than to provide perhaps two additional insulated tanks similar to 164 and a refrigeration system to keep the stored LNG liquid for a long period of time. It is noted that a refrigeration system generally is not provided for the tanks 164 in a case where they receive LNG from a tanker 190. This is because it is generally desirable to immediately heat such LNG which has been offloaded to the floating structure 170, for use in the power plant and to provide CNG (compressed natural gas) to shuttles that deliver it to a local coastal station. A valve structure 192 is controllable to direct natural gas from one of the tanks 164 (after the LNG has been warmed so it is gaseous) to the power plant 182, or to direct liquid hydrocarbons from a tank 176 to the power plant when warmed LNG is not available at the local supply station.

Thus, the invention provides systems for bringing natural gas to local communities that are in the vicinity (e.g. within 20 kilometers) of an ocean coast. This is done by providing a local supply station which receives large amounts of natural gas, either as LNG from tankers, or as gaseous hydrocarbons from a local hydrocarbon reservoir. Where the natural gas is LNG received from a tanker, the local supply station stores the LNG in insulated tanks and offloads it to shuttle boats that carry the LNG over the sea to facilities at local coastal stations. At a local coastal station the LNG is heated to regas it, by regas equipment at the local coastal station, or possibly by regas equipment on the shuttle boat. Where the natural gas is produced from a reservoir at the local supply station, the natural gas is preferably compressed and the CNG (compressed natural gas) is carried by shuttles with CNG-holding tanks to the local coastal stations.

Although particular embodiments of the invention have been described and illustrated herein, it is recognized that modifications and variations may readily occur to those skilled in the art, and consequently, it is intended that the claims be interpreted to cover such modifications and equivalents.

What is claimed is:

1. A method for supplying a mass of hydrocarbons that is gaseous at common environmental temperatures, to each of a plurality of communities that are each located in the vicinity of local coastal stations wherein each local coastal station is located adjacent to an ocean shore, including creating LNG (liquefied natural gas) by producing gaseous hydrocarbons from an underground hydrocarbon reservoir and cooling the produced hydrocarbons to create hydrocarbons in the form of LNG, comprising:

loading said hydrocarbons in the form of LNG onto a tanker that has an LNG storage capacity of at least 50 million standard cubic feet of gas, sailing said tanker at least 100 kilometers to a local supply station, offloading said hydrocarbons in the form of LNG from said tanker to said local supply station and storing said hydrocarbons in the form of LNG at said local supply station, and sailing said tanker away from said local supply station as soon as said hydrocarbons in the form of LNG is offloaded while continuing to store said hydrocarbons in the form of LNG at said local supply station;

transferring a mass of said stored hydrocarbons in the form of LNG from said local supply station to a shuttle boat that has an LNG storage capacity of less than 25% of the LNG storage capacity of said tanker, and sailing said shuttle boat to at least one of a plurality of said local coastal stations;

at each of said local coastal stations, transferring a mass of said hydrocarbons from said shuttle boat to the local coastal station, heating LNG to produce gaseous hydrocarbons, and distributing gaseous hydrocarbons through pipelines to local customers.

2. The method described in claim 1 wherein:

said steps of transferring to a shuttle boat and sailing said shuttle boat, includes sailing said shuttle boat to each of a plurality of said coastal stations, and at each local coastal station transferring to the local coastal station only a portion of the mass of hydrocarbons that was transferred to said shuttle boat at the local supply station.

3. The method described in claim 1 wherein:

said steps of transferring from said supply station to a shuttle boat and sailing said shuttle boat, includes transferring LNG to each of a plurality of different but identical shuttle boats and sailing each shuttle boat to at least one local coastal station.

* * * * *